US006267303B1

(12) United States Patent
Francis

(10) Patent No.: US 6,267,303 B1
(45) Date of Patent: Jul. 31, 2001

(54) SPRINKLER SYSTEM FERTILIZER INJECTOR

(76) Inventor: Douglas W. Francis, 40 McIntosh Ct., Hurlburt Field, FL (US) 32544

( * ) Notice: Subject to any disclaimer, the term of this patent is extended or adjusted under 35 U.S.C. 154(b) by 0 days.

(21) Appl. No.: 09/406,393

(22) Filed: Sep. 27, 1999

(51) Int. Cl.[7] ..... B05B 7/30
(52) U.S. Cl. ..... 239/318; 137/893
(58) Field of Search ..... 239/19, 22, 39, 239/44, 76, 210, 265.17, 265.19, 310, 318, 347, 424.5; 222/518; 137/205.5, 268, 564.5, 587, 893

(56) References Cited

U.S. PATENT DOCUMENTS 1,220,336 * 3/1917 Hornsby ..... 137/205.5
2,246,827 * 6/1941 Wixom ..... 137/893
2,602,697 * 7/1952 Otto et al. ..... 239/310
2,856,234 * 10/1958 McNair et al. ..... 239/310
2,919,073 * 12/1959 Akselrad et al. ..... 239/310
3,194,444 * 7/1965 Hubert ..... 239/310
3,204,661 * 9/1965 Young ..... 137/564.7
3,658,091 * 4/1972 Buzzi ..... 137/604
3,669,357 * 6/1972 Overbey ..... 239/318
3,726,304 * 4/1973 Cook ..... 137/564.5
4,295,545 * 10/1981 Hiei ..... 137/205.5
4,883,086 * 11/1989 Lejnar ..... 137/893

* cited by examiner

*Primary Examiner*—Andres Kashnikow
*Assistant Examiner*—Jorge Bocanegra
(74) *Attorney, Agent, or Firm*—John Wiley Horton, Attorney

(57) ABSTRACT

A device for injecting liquid chemical solutions into the flow of a lawn sprinkler system. The device allows the user to easily attach and remove chemical jars without the risk of losing the prime on the pump.

3 Claims, 11 Drawing Sheets

SPRINKLER SYSTEM FERTILIZER INJECTOR

BACKGROUND

Field of Invention

This invention relates to the field of lawn sprinkler system. Specifically, the invention comprises a fertilizer injector which may be placed in the water lines feeding the sprinkler system in order to introduce fertilizer or other fluids into the sprinkler system.

OBJECTS AND ADVANTAGES

The sprinkler systems presently available do not provide a means to introduce fertilizer or other desirable chemicals into the system. As a result, the homeowner must often spread or spray the lawn chemicals in a separate and time-consuming operation. The primary object of the present invention is to use the existing sprinkler system to spread the lawn chemicals during the normal irrigation process. Additional objects of the present invention are as follows:

(1) to allow the user to easily turn the chemical adding device on and off;

(2) To allow the user to disconnect the chemical container from the system without losing the prime on the sprinkler pump;

(3) To provide a fast means for switching chemical containers so that the user may add several different types of chemicals during a single irrigation cycle; and (4) To provide a chemical adding device which may be used with many different types of existing sprinkler systems.

These objects and advantages will be fully explained in the details hereafter described, explained, and claimed, with reference being made to the accompanying drawings.

DRAWING FIGURES

REFERENCE NUMERALS IN DRAWINGS

| | | | |
|---|---|---|---|
| 10 | well pipe | 12 | injector assembly |
| 14 | pump | 16 | pump inlet |
| 18 | pump outlet | 20 | sprinkler distribution valve |
| 22 | sprinkler circuit | 24 | injector tee |
| 26 | distribution valve | 28 | check valve |
| 30 | injection venturi | 32 | relief venturi |
| 34 | mounting flange | 36 | jar |
| 38 | suction tube | 40 | threads |
| 42 | water passage | 44 | suction tube mount |
| 46 | intake | 48 | check ball |
| 50 | spring | 52 | rotary valve |
| 54 | check valve intake | 56 | check valve outlet |
| 60 | valve key | 62 | valve switch |
| 64 | vent valve | 66 | pull plunger |
| 68 | vent | 70 | vent passage |
| 72 | pinhole vent | 74 | distribution valve bore |
| 76 | rotary valve bore | 78 | valve switch passage |
| 80 | plunger seat | 82 | alternate vent |

DESCRIPTION

Figure 1:
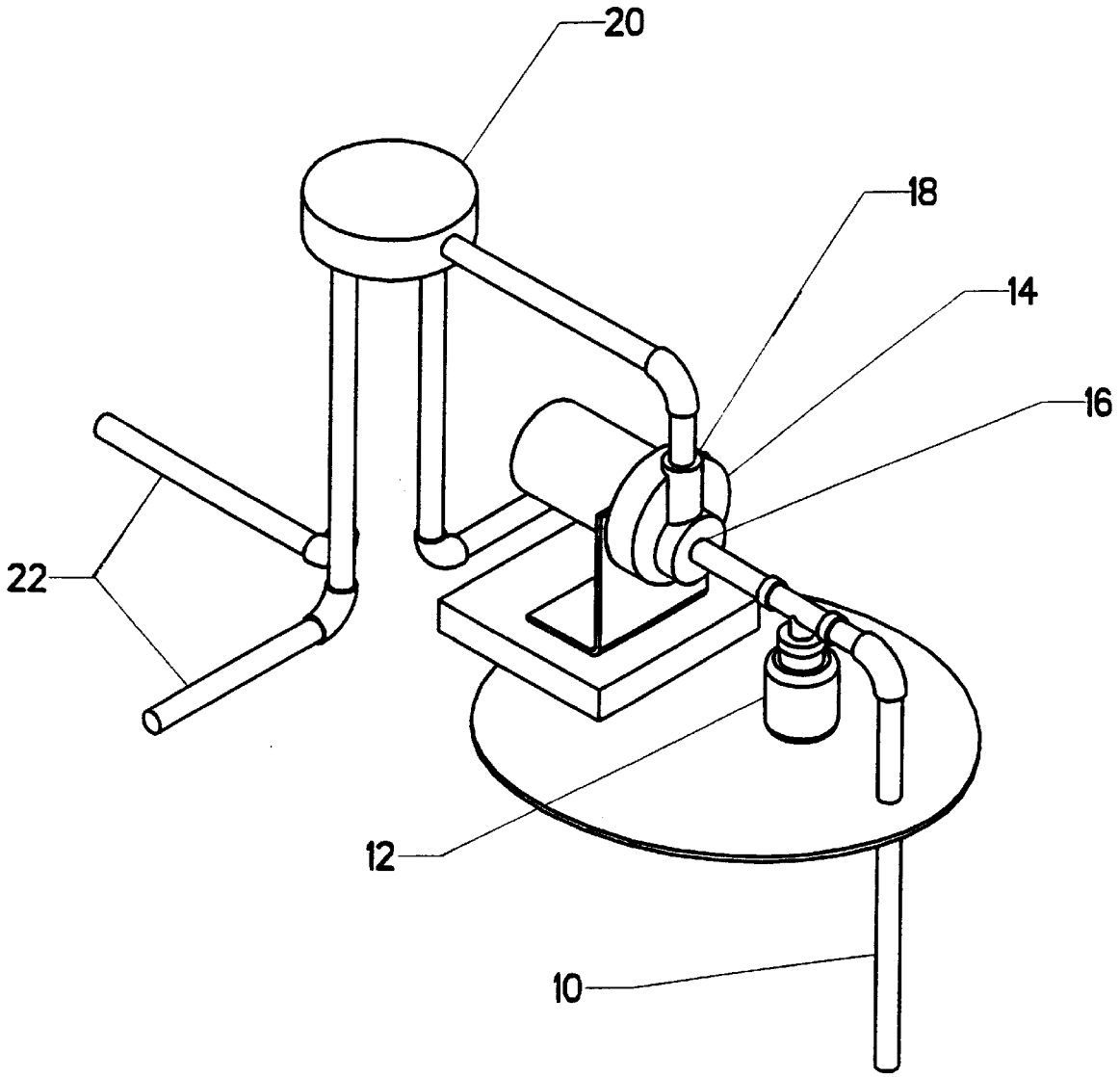
FIG. 1 is an isometric view, showing the invention incorporated in a typical sprinkler system.

FIG. 1 depicts a typical lawn sprinkler system. Well pipe 10 is placed into the earth at a depth sufficient to reach the local water table. Pump 14 pulls the water up through well pipe 10 and into pump inlet 16. Pump 14 then pressurizes the water and discharges it through pump outlet 18. From that point, the pressurized water flows into sprinkler distribution valve 20, where it is split into several sprinkler circuits 22.

Persons skilled in the art will recognize that it is very important to maintain the prime on pump 14. If the prime is lost, pump 14 may become air locked and therefore unable to lift the water up well pipe 10. The user would then have to reprime pump 14.

Figure 2:
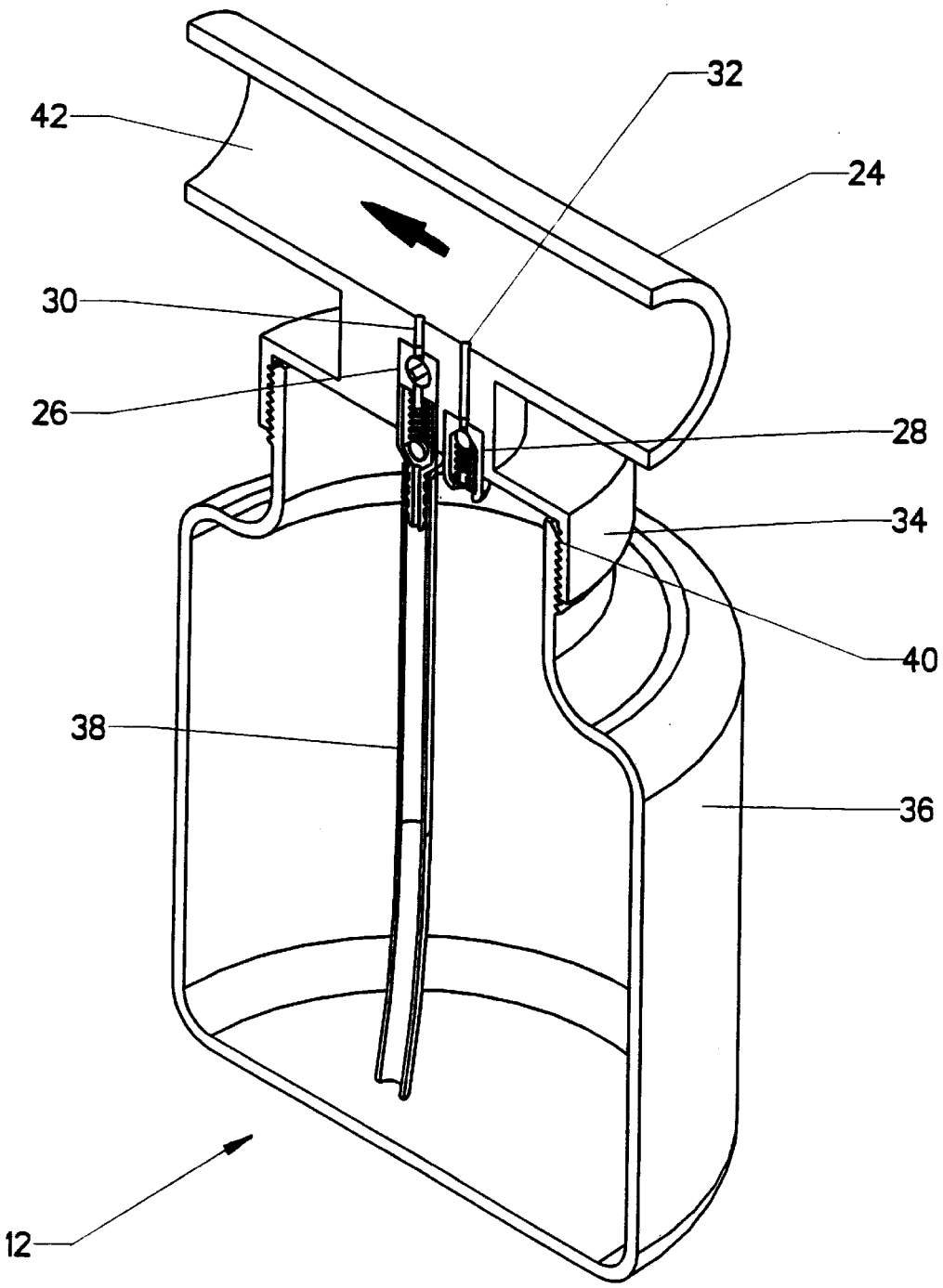
FIG. 2 is an isometric sectional view, showing more detail of the proposed invention.

Injector assembly 12 is placed into the system just before pump inlet 16. The purpose of injector assembly 12 is to allow the user to inject fertilizer or other chemicals into the sprinkler system, thereby feeding them to the lawn. Turning now to FIG. 2, injector assembly 12 will be described in more detail.

Because it is important to understand several internal passages found within injector assembly 12, FIG. 2 shows the components in a section view. Injector tee 24 joins injector assembly 12 to the water lines. Many conventional methods may be used to ensure a leak-proof connection. The open ends of injector tee 24 could be threaded for compression fittings. Alternatively, the open ends could be joined to the water lines by PVC glue. As these methods are well known in the prior art, they have not been illustrated.

Inside injector tee 24 is water passage 42. Water flows through the device and toward pump 14 in the direction shown by the arrow. Mounting flange 34 is provided for the mounting of jar 36. Jar 36 actually contains the liquid solution which the user wishes to inject into the sprinkler system. Jar 36 is removably attached to mounting flange 34 by threads 40. It is important to achieve an air-tight seal between jar 36 and mounting flange 34.

Two internal passages connect with water passage 42: injection venturi 30 and relief venturi 32. Directly connected to injection venturi 30 is distribution valve 26. Suction tube 38 is connected to the lower end of distribution valve 26. Suction tube 38 extends down to the bottom ofjar 36. Its purpose is to pull in the liquid contained within jar 36 and carry it up to distribution valve 26. The purpose of distribution valve 26 is to control the flow of liquid proceeding from jar 36, through injection venturi 30, and into water passage 42.

Figure 3:
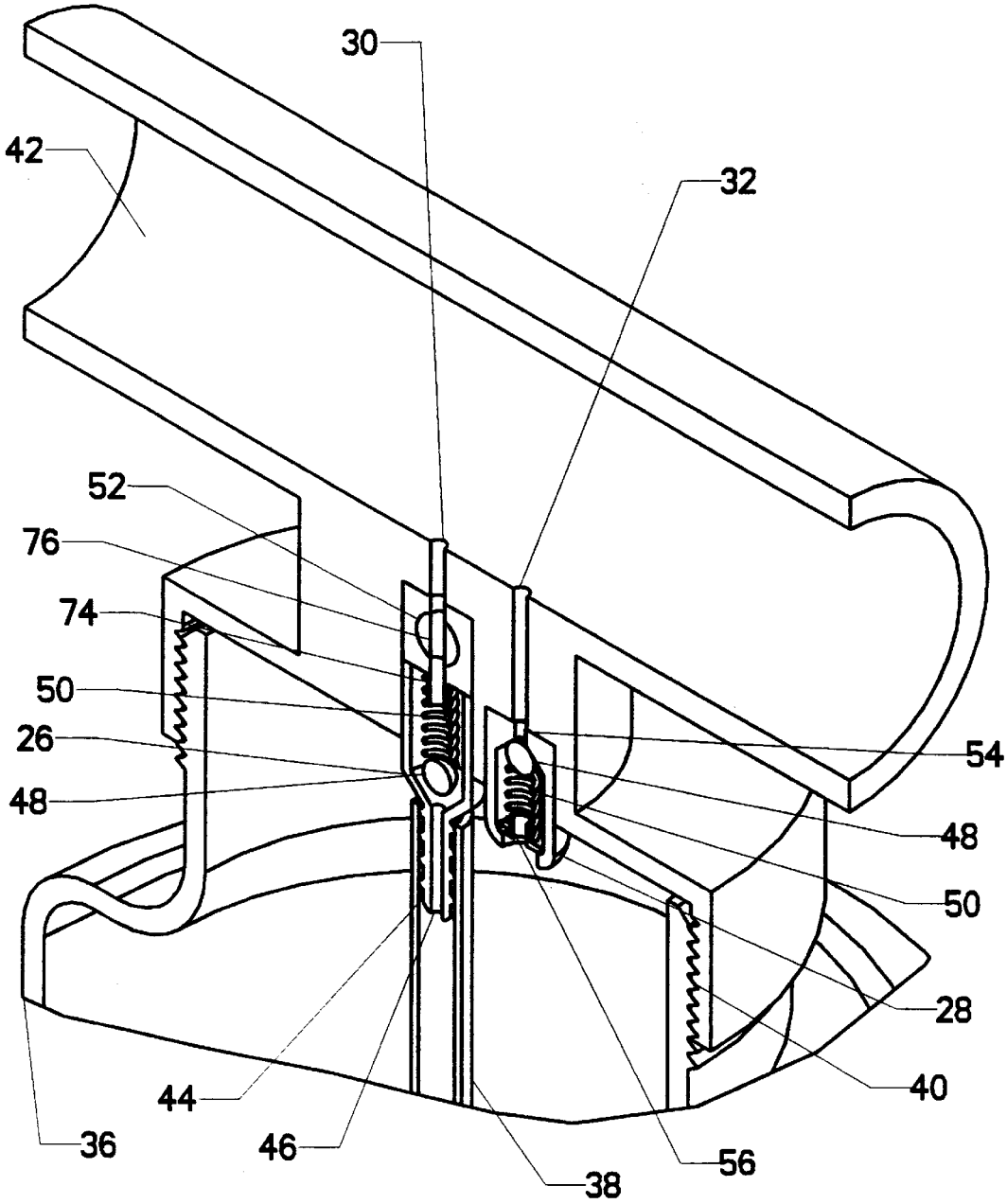
FIG. 3 is an isometric section view, showing the details of the valves employed.

Directly connected to relief venturi 32 is check valve 28. The purpose of check valve 28 is to control the flow of liquid from water passage 42 into jar 36. Turning now to FIG. 3, the function of the valves will be explained in greater detail.

The suction induced by pump 14 causes the water within water passage 42 to flow at relatively high velocity, creating suction at injection venturi 30. This phenomenon is well known in the prior art. The induced suction naturally tends to pull liquid up out of jar 36 and into the moving stream within water passage 42. The lower end of distribution valve 26 is formed into a projection designated as suction tube mount 44. Suction tube mount 44 is designed to tightly fit inside the inner diameter of suction tube 38, and frictionally hold it in place. Suction tube mount 44 has intake 46, which allows the liquid flowing up suction tube 38 to enter the interior of distribution valve 26.

Distribution valve 26 has check ball 48, which is held against its seat by spring 50. Distribution valve 26 also has rotary valve 52. Rotary valve 52, which is an integral part of check valve 26, has rotary valve bore 76 which can be aligned with distribution valve bore 74. When rotary valve 52 is in the position shown in FIG. 3, it directly connects injection venturi 30 to the interior of distribution valve 26. The induced suction of injection venturi 30 then tends to lift check ball 48 off its seat and allow fluid to flow up suction tube 38, through distribution valve 26, through injection venturi 30, and into water passage 42.

Check ball 48 is a very important feature of distribution valve 26. When pump 14 is shut off, water flow ceases within water passage 42. At that point check ball 48 is forced by spring 50 back against its seat, whereby it seals the entrance to water passage 42. Without this feature, if pump 14 were shut down after all the liquid had been removed from jar 36, air within jar 36 could enter water passage 42 and cause pump 14 to lose its prime.

In the embodiment shown in FIG. 3, jar 36 is not vented to the surrounding air. As liquid is removed from jar 36, the pressure within jar 36 drops significantly lower than the pressure in the surrounding air. This fact makes jar 36 very difficult to remove from mounting flange 34. Check valve 28 in included to remedy this problem. After pump 14 shuts down, the vacuum within jar 36 pulls check ball 48 in check valve 28 off its seat and water flows from water passage 42, through relief venturi 32, through check valve intake 54, past check ball 48, out check valve outlet 56 and into jar 36. This flow then raises the pressure within jar 36. When the pressure within jar 36 approaches the pressure within water passage 42, check valve 28 will again close, whereupon jar 36 may be easily removed from mounting flange 34.

Figure 4:
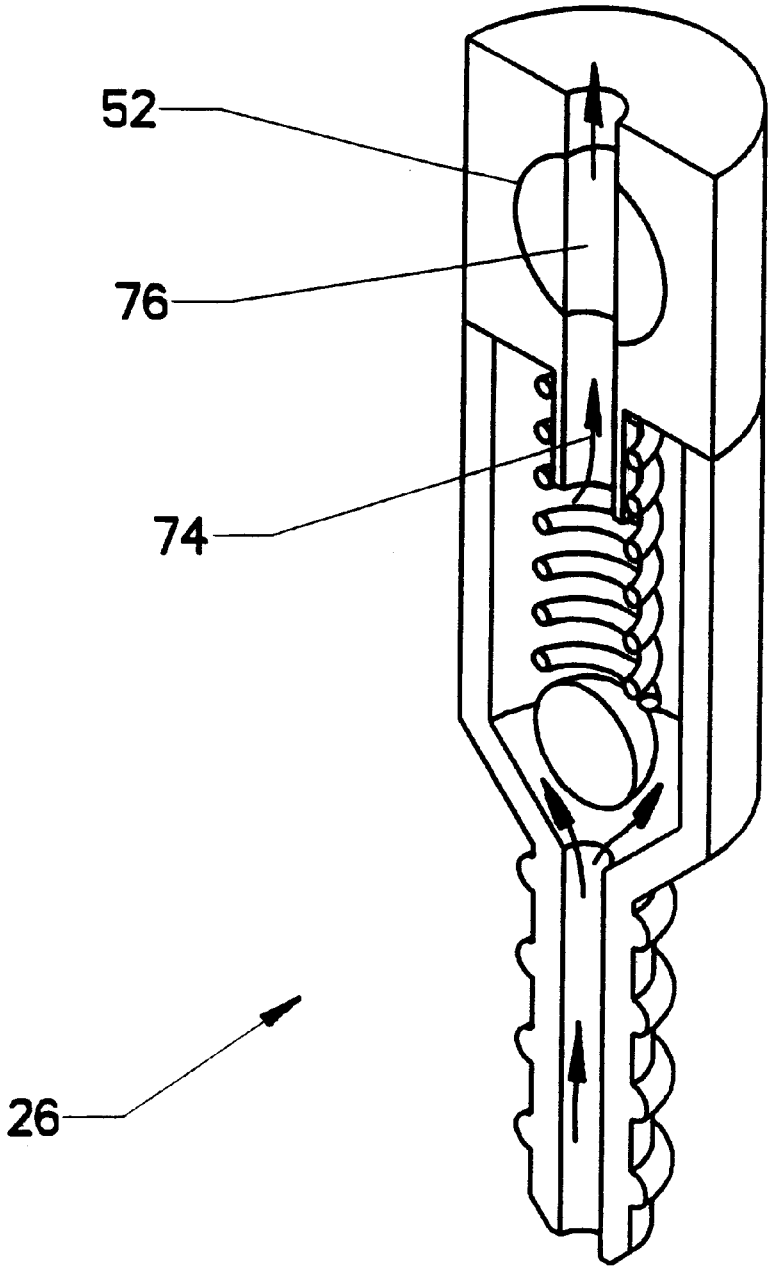
FIG. 4 is an isometric section view, showing the internal components of the distribution valve.
Figure 5:
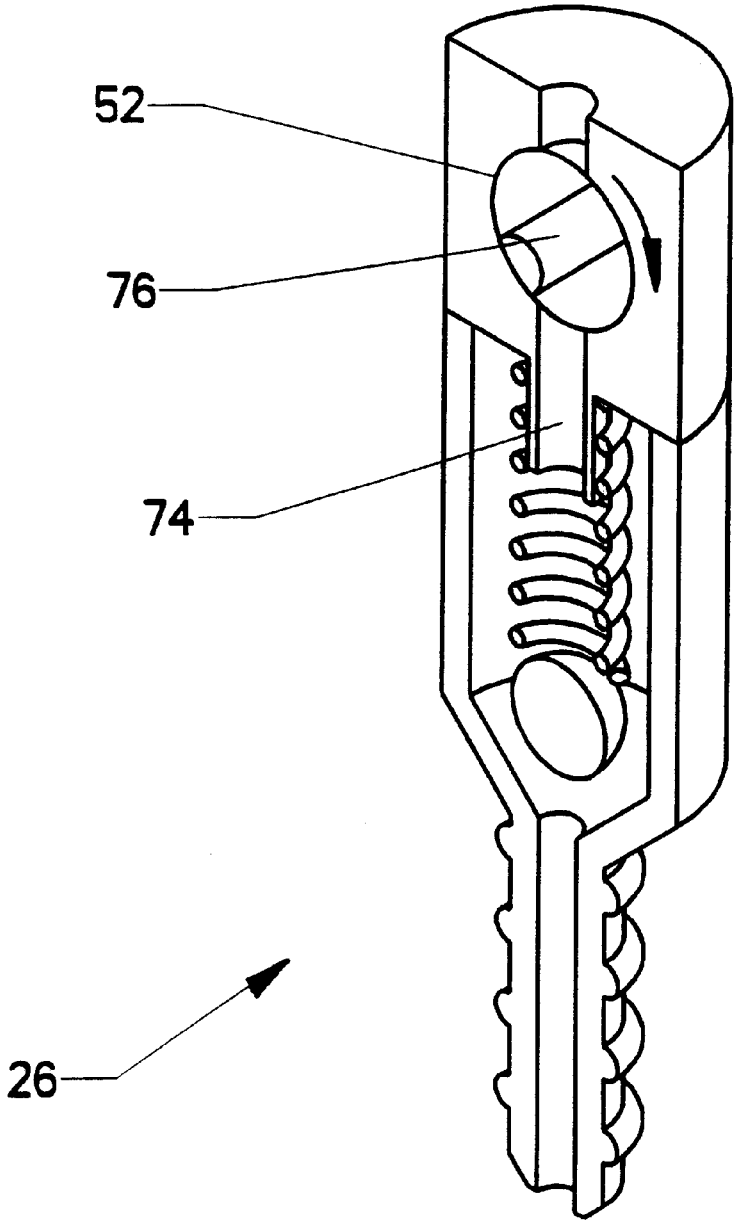
FIG. 5 is an isometric section view, showing the internal components of the distribution valve in the "off" position.

FIG. 4 shows an enlarged view of distribution valve 26. Rotary valve 52 is provided to control the fluid flow through distribution valve 26. In the position shown, rotary valve bore 76 is aligned with distribution valve bore 74, meaning that the valve is in the "ON" position. Turning to FIG. 5, rotary valve 52 may be rotated in the direction shown so that rotary valve bore 76 is no longer perfectly aligned with distribution valve bore 74. In this position, flow through distribution valve 26 is reduced. If rotary valve 52 is rotated still further, all flow will be cut off and the valve will be in the "OFF" position. Thus, the reader will appreciate that rotary valve 52 may be used to continuously adjust the flow through distribution valve 26.

Figure 6:
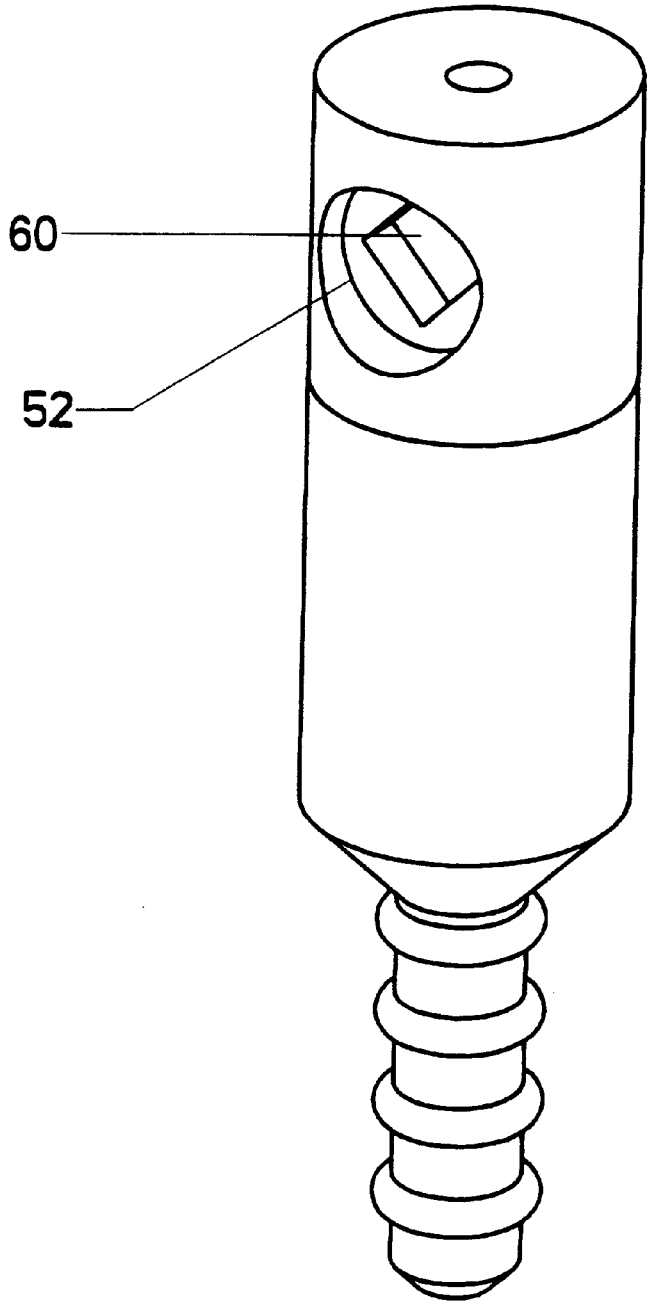
FIG. 6 is an isometric view of the distribution valve.
Figure 7:
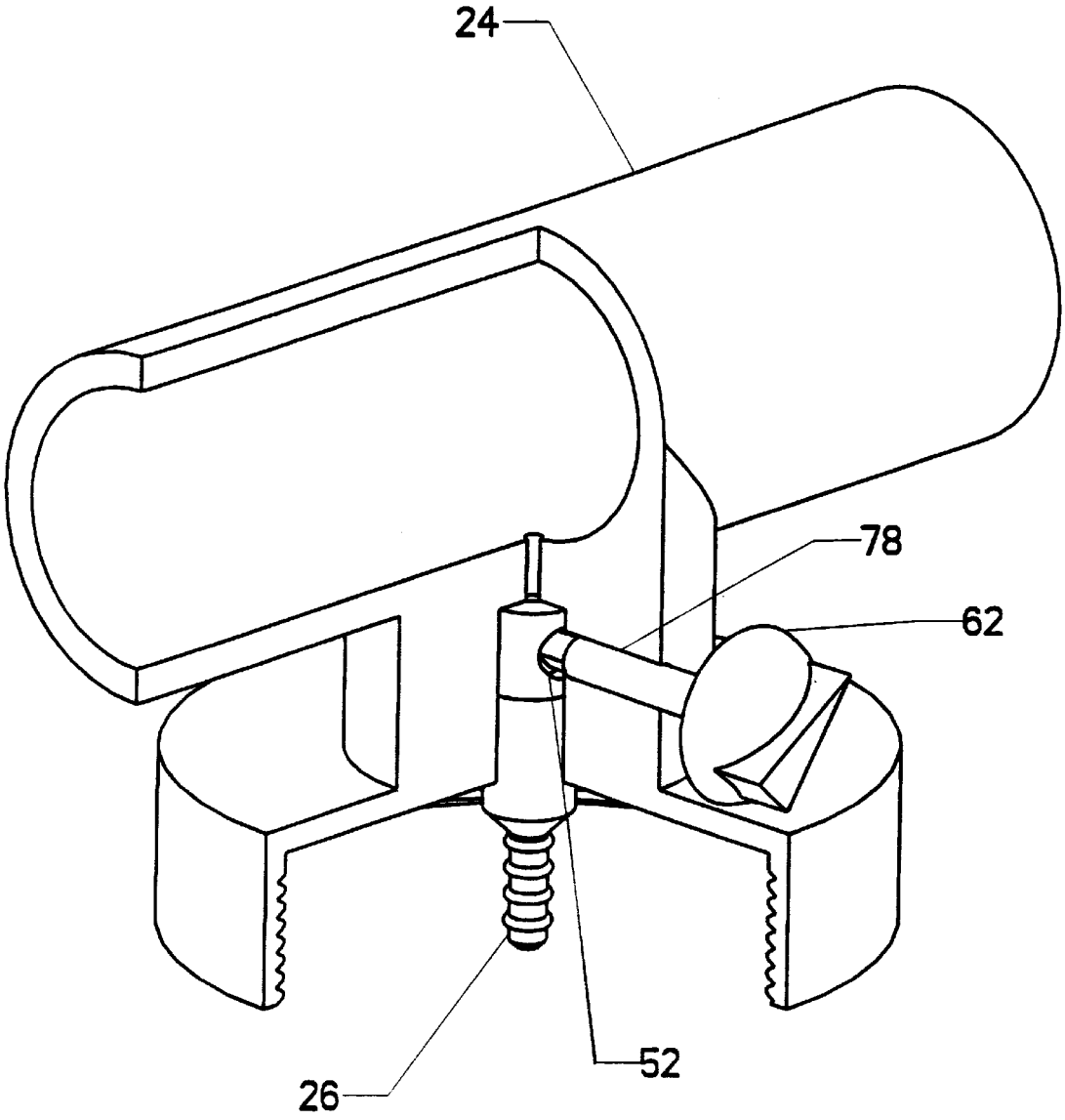
FIG. 7 is an isometric section view, showing how the distribution valve may be turned on and off using an external switch.

FIG. 6 shows distribution valve 26 in a conventional view. Rotary valve 52 has a square valve key 60 cut into its external face so that another piece can engage and rotate rotary valve 52. Turning now to FIG. 7, the reader will observe that valve switch 62 is shaped and sized to fit within valve switch passage 78. The end of valve switch 62 is shaped and sized to engage valve key 60, so that when valve switch 62 is turned manually, rotary valve 52 is turned. Valve switch 62 is located to be easily accessible to the user. The user turns valve switch 62 in order to regulate the flow of liquid within jar 36 into the sprinkler system. It is helpful to provide reference markings on injector tee 24 so that the user understands which orientation of valve switch 62 is "ON" and which orientation is "OFF." As such markings are commonly understood in the art, they have not been illustrated.

The user desiring to operate the device follows a simple procedure. Returning to FIG. 2, the user unscrews jar 36 from mounting flange 34. The operation of the valves, as described earlier, prevents the loss of pump prime. The user fills jar 36 with the desired liquid (often a fertilizer solution). Jar 36 is then screwed tightly back into mounting flange 34. Turning to FIG. 7, the user then sets valve switch 62 to the desired setting.

Sprinkler systems are typically run on a timer. The timer most often switches the system on in the early morning. It is important to realize that the user can fill jar 36 and set valve switch 62 at any time—even while pump 14 is running (although valve switch 62 must be placed in the "OFF" position before removing jar 36). Thus, the user does not need to worry about when the sprinkler system will run. He or she simply fills the jar, sets the switch, and leaves the device in place.

Although the preceding description constitutes one of the invention's embodiments, several alternate embodiments are also effective. Returning now to FIG. 3, the reader will recall that check valve 28 is provided to prevent the pressure within jar 36 from dropping too low as liquid is drawn out ofjar 36. The Applicant has experimentally determined that if a flexible material is used for jar 36, check valve 28 can be eliminated. This results from the fact that jar 36 will partially collapse as the liquid is drawn out, preventing the pressure from dropping too low. This alternate embodiment is illustrated in FIG. 10.

Figure 10:
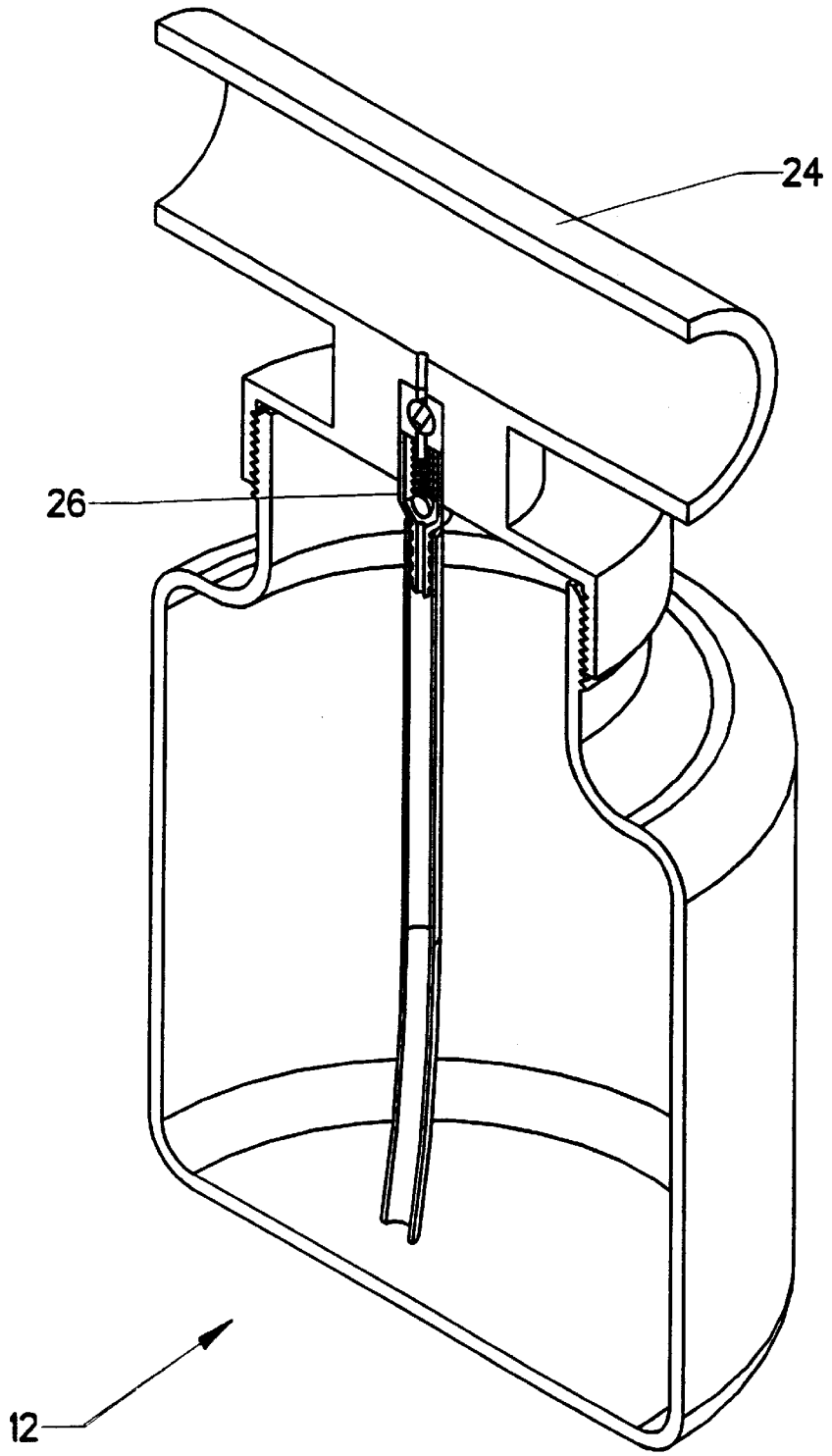
FIG. 10 is an isometric section view, showing an alternate embodiment without a check valve.

While the embodiment shown in FIG. 10 does work, the vacuum within jar 36 can make it very difficult to remove. Thus, another component is desirable in order to dissipate the vacuum within jar 36 before the user can remove jar 36 from mounting flange 34.

Figure 8:
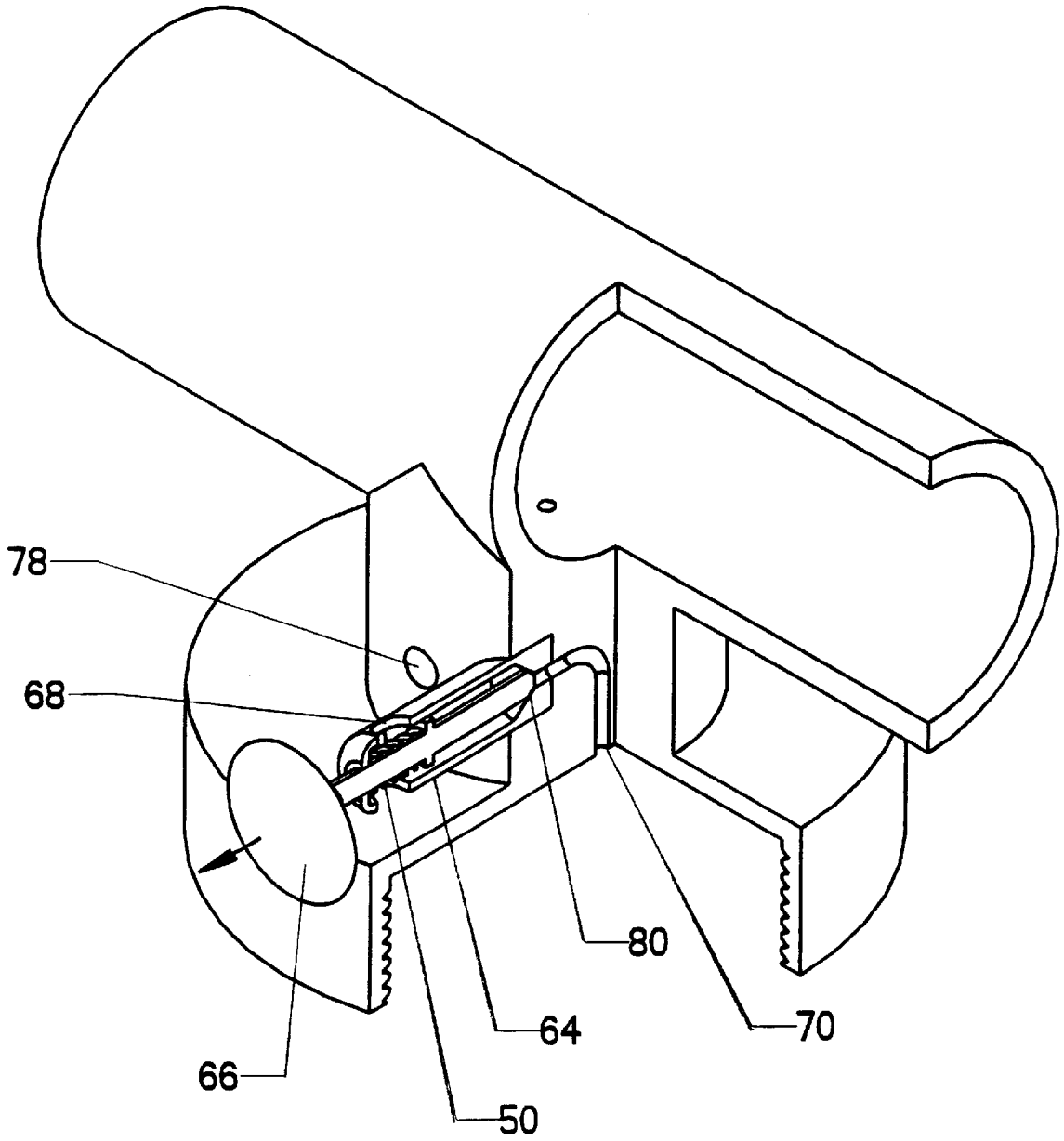
FIG. 8 is an isometric section view, showing an alternate embodiment incorporating a vent valve.

FIG. 8 illustrates the remedy to this recognized problem. The reader should note that valve switch 62 is not shown in FIG. 8, for purposes of visual simplicity. Valve switch passage 78 is shown—which illustrates where valve switch 62 would be inserted. In the alternate embodiment shown in FIG. 8, vent passage 70 occupies the space occupied by check valve 28 in the embodiment depicted in FIG. 3. Vent passage 70 connects the inside of jar 36 to vent valve 64. As explained previously, the operation of the system causes a significant vacuum within jar 36. The user desiring to remove jar 36 must first dissipate this vacuum.

Vent valve 64 has moveable pull plunger 66. Pull plunger 66 is held tightly against plunger seat 80 by spring 50. Thus, in the position shown, vent valve 64 does not allow flow between the inside of jar 36 and the surrounding air. In order to release the vacuum within jar 36, the user grasps pull plunger 66 and pulls it in the direction shown by the arrow. This motion pulls pull plunger 66 off of plunger seat 80. Surrounding air then rushes in vents 68, through the internal cavity of vent valve 64, past plunger seat 80, through vent passage 70, and into the interior of jar 36. The vacuum is thereby dissipated and jar 36 may easily be removed.

Figure 9:
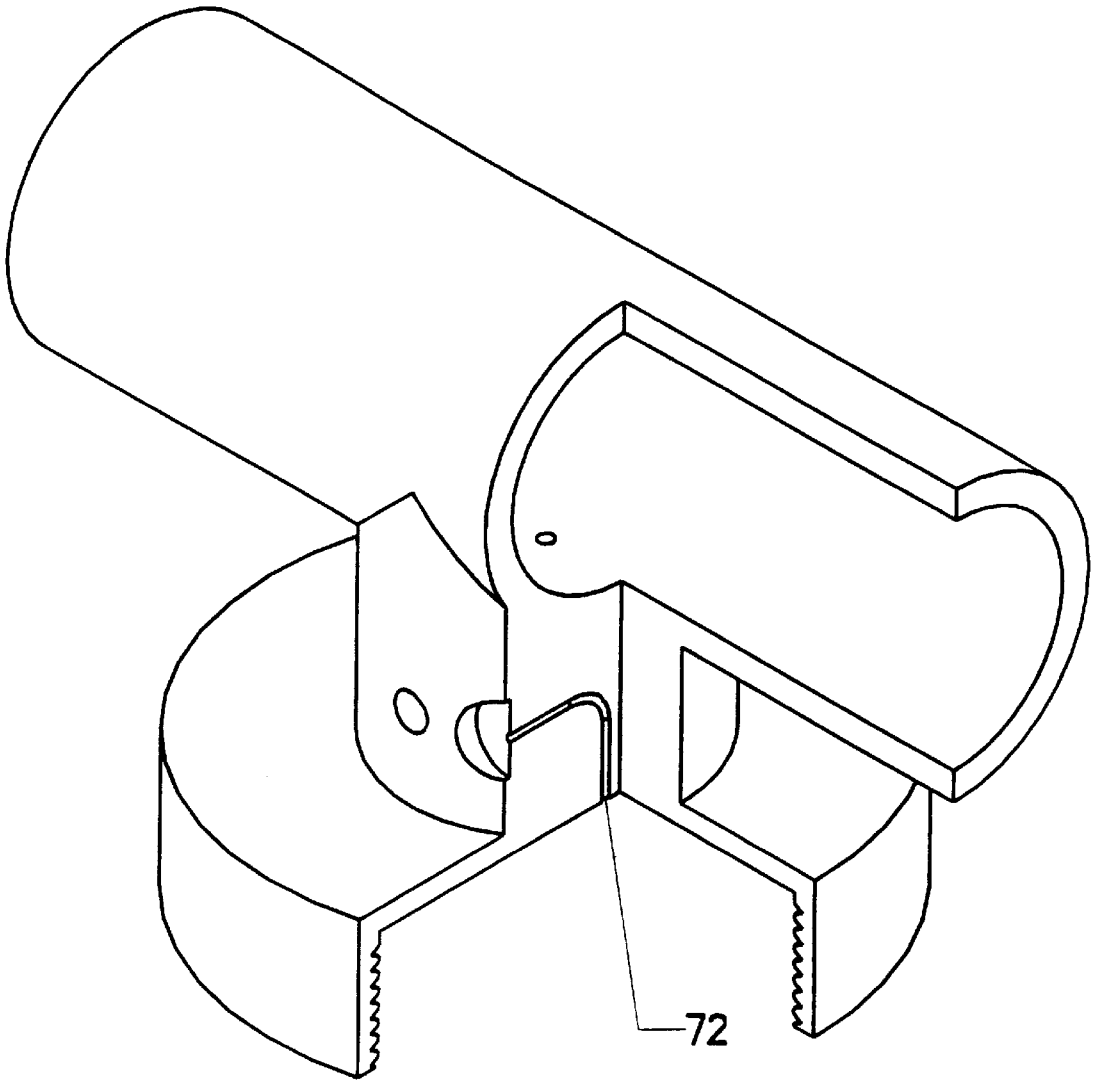
FIG. 9 is an isometric section view, showing an alternate embodiment incorporating a pinhole vent.

FIG. 9 illustrates another alternate embodiment. In this alternate embodiment, vent valve 64 is removed and pinhole vent 72 is simply left open to the surrounding air. This embodiment reduces cost by eliminating the need for check valve 28 and vent valve 64. However, the diameter of pinhole vent 72 must be carefully coordinated with the workings of distribution valve 26. Otherwise, once all the liquid within jar 36 has been consumed, air may be drawn through distribution valve 26. If enough air is drawn in, pump 14 can lose its prime. Thus, the reader will appreciate that although the alternate embodiment shown in FIG. 9 is cheaper, it may be less effective in maintaining pump prime in some circumstances.

Preferred Embodiment

Figure 11:
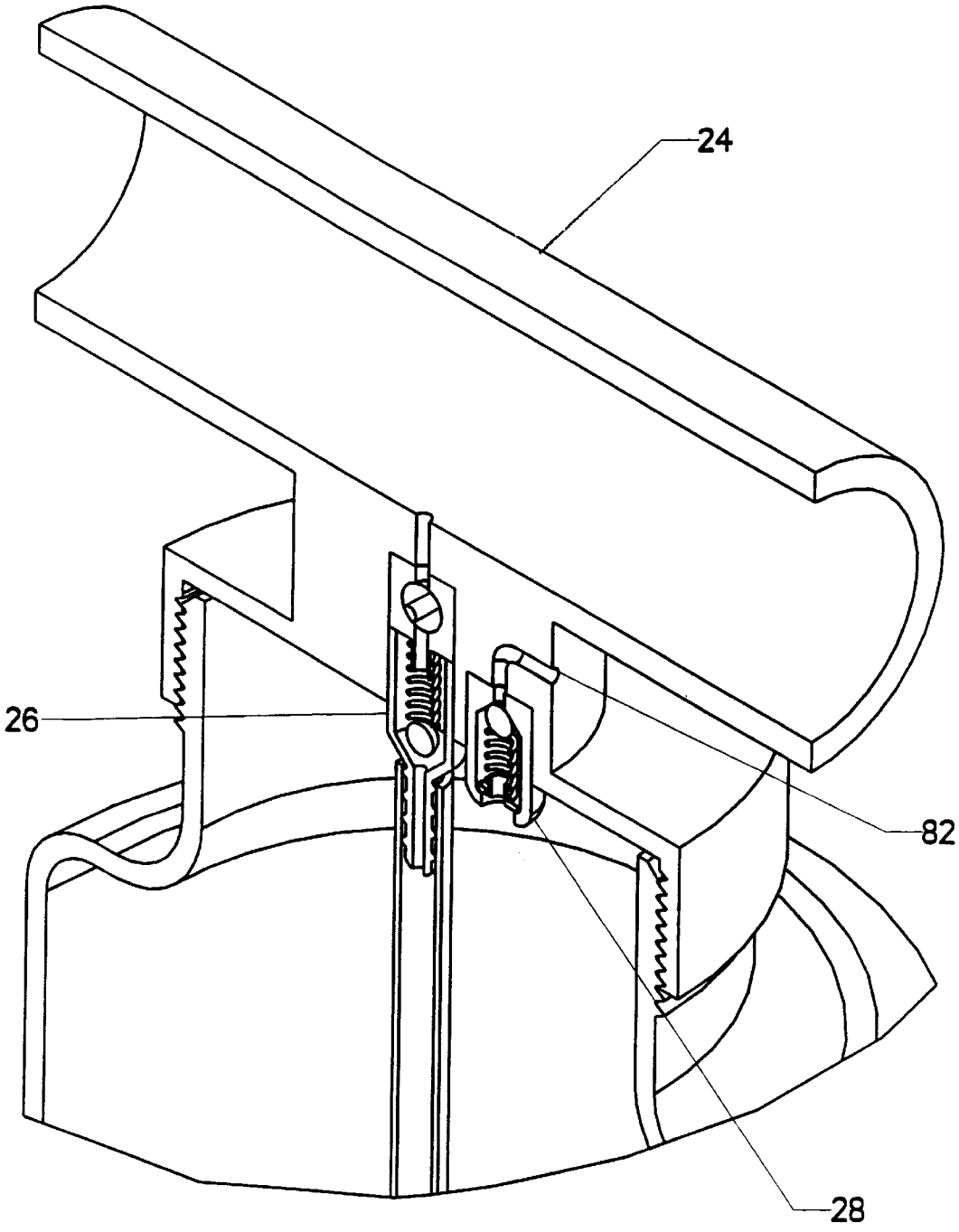
FIG. 11 is an isometric view, showing the preferred embodiment.

FIG. 11 illustrates the preferred embodiment. In this embodiment, check valve 28 is connected to the surrounding air by alternate vent 82. As fluid is pulled out of jar 36 and pressure drops within jar 36, check valve 28 will open to allow pressure equalization through alternate vent 82. In this configuration, the operation of check valve 28 prevents the build-up of significant vacuum within jar 36. When pump 14 is shut down, check valve 28 closes, thereby sealing jar 36 and preventing the loss of pump prime. When pump 14 is running, check valve 28 will cycle open in the event that a significant vacuum builds within jar 36. In this respect, the preferred embodiment is superior in operation to the embodiment depicted in FIG. 2. The embodiment depicted in FIG. 2 only tends to equalize pressure after pump 14 has shut down. The preferred embodiment, on the other hand, prevents the build-up of significant vacuum.

Summary, Ramifications, and Scope

Accordingly, the reader will appreciate that the proposed invention allows the user to easily inject liquids into an existing sprinkler system. Furthermore, the proposed invention has additional advantages in that:

1. It allows the user to add the desired liquids without losing pump prime;
2. It allows the user to easily turn the chemical adding device on and off;
3. It allows the user to rapidly switch chemical containers so that the user may add several different types of chemicals during a single irrigation cycle; and Although the preceding description contains significant detail, it should not be construed as limiting the scope of the invention but rather as providing illustrations of the preferred embodiment of the invention. Many alterations could be made without changing the basic scope of the present invention. As an example, the injector tee could incorporate multiple jars so that more than one chemical could be added simultaneously. Thus, the scope of the invention should be fixed by the following claims, rather than by the examples given.

Having described my invention, I claim:

1. A device for allowing a user to inject liquid chemical solutions into the well pipe of a sprinkler system so that said injected chemical solutions will be carried into a pump and from thence into the sprinkler circuits, comprising:

a. an injector tee, being attached to said well pipe of said sprinkler system, with said injector tee having a internal water passage oriented to allow the flow of water through said well pipe to flow through said injector tee;

b. a mounting flange, being integrally formed with said injector tee, and being in the shape of a vertical cylinder extending downward from said injector tee, with the lower surface of said mounting flange opening into an interior cylindrical cavity, with the vertical surface of said cylindrical cavity being cut by female threads, and with the horizontal surface of said cylindrical cavity opening into an injection venturi passing from said cylindrical cavity to said water passage, thereby allowing fluid communication between said cylindrical cavity and said water passage;

c. a hollow jar, with the upper portion of said jar being formed in the shape of a hollow vertical cylinder, with the outer vertical surface of said hollow vertical cylinder being formed into male threads, and being sized so that said hollow jar threads tightly into said interior cylindrical cavity of said mounting flange, with said male threads bearing tightly against said female threads; and d. means for conveying said liquid chemical solutions contained within said jar up to said injection venturi, so that as the water flowing within said water passage induces suction at said injection venturi, said chemical solutions are drawn out of said jar and injected into said water passage;

e. said means for conveying said liquid chemical solution having a distribution valve, with an upper end and a lower end, with said upper end opening into a hollow interior cavity passing vertically thorough said distribution valve and exiting at said lower end, with said upper end being immediately adjacent to said injection venturi so that fluid passing through said distribution valve may pass through said injection venturi;

f. a hollow suction tube, having an upper end and a lower end, with said upper end being removably attached to said lower end of said distribution valve, and with said lower end being in close proximity with the bottom of said jar; and g. means withing said distribution valve for continuously regulating the flow of said chemical solutions from zero to full flow;

h. wherein said horizontal surface of said cylindrical cavity also opens into a vent passage passing from said cylindrical cavity to the surrounding air, thereby allowing fluid communication between said cylindrical cavity and said surrounding air, and wherein flow within said vent passage is regulated by a vent valve, with said vent valve having a pull plunger which is normally biased against a plunger seat in order to obstruct all flow through said vent passage, but which may be grasped by said user and pulled to momentarily allow flow through said vent passage so as to equalize the pressure withing said jar and said surrounding air.

2. A device as recited in claim 1, wherein said horizontal surface of said cylindrical cavity also opens into a relief venturi passing from said cylindrical cavity to said water passage, thereby allowing fluid communication between said cylindrical cavity and said water passage, and wherein flow within said relief venturi is regulated by a check valve, which permits flow from said water passage to said cylindrical cavity, but prevents flow in the reverse direction.

3. A device as recited in claim 1, wherein said horizontal surface of said cylindrical cavity also opens into an alternate vent passing from said cylindrical cavity to the air surrounding said jar, thereby allowing fluid communication between said cylindrical cavity and said air surrounding said jar, and wherein flow within said alternate vent is regulated by a check valve, which permits flow from said air surrounding said jar to said cylindrical cavity, but prevents flow in the reverse direction.

* * * * *